US005880754A

United States Patent [19]

Niikura et al.

[11] Patent Number: 5,880,754

[45] Date of Patent: Mar. 9, 1999

[54] RECORDING APPARATUS INCLUDING RECORDING HEAD AND TEMPERATURE STABILIZATION PORTION

[75] Inventors: Takeji Niikura, Kawasaki; Yoji Ara, Yokohama; Tsutomu Shimada, Musashino; Shoichi Kan, Yokohama; Masaaki Kakizaki, Kawasaki; Nozomu Nishiberi, Yokohama; Yasushi Koike, Kawasaki; Seiji Ogasawara, Yokohama, all of Japan

[73] Assignee: Canon Kabushiki Kaisha, Tokyo, Japan

[21] Appl. No.: 452,157

[22] Filed: May 26, 1995

[30] Foreign Application Priority Data

| | | | |
|---|---|---|---|
| May 30, 1994 | [JP] | Japan | 6-116812 |
| Feb. 21, 1995 | [JP] | Japan | 7-031269 |
| May 18, 1995 | [JP] | Japan | 7-120169 |

[51] Int. Cl.[6] ..... B41J 29/377

[52] U.S. Cl. ..... 347/18

[58] Field of Search ..... 347/18, 14, 17, 347/32, 92; 400/719, 720, 352, 320, 124.13; 361/704, 707, 709, 714, 719, 720

[56] References Cited

U.S. PATENT DOCUMENTS

| | | | |
|---|---|---|---|
| 4,867,590 | 9/1989 | Brull et al. | 400/352 |
| 5,138,332 | 8/1992 | Carlotta | 347/92 |
| 5,343,230 | 8/1994 | Dietl | 347/31 |
| 5,512,924 | 4/1996 | Takada et al. | 347/18 |

*Primary Examiner*—N. Le
*Assistant Examiner*—L. Anderson
*Attorney, Agent, or Firm*—Fitzpatrick, Cella, Harper & Scinto

[57] ABSTRACT

An ink jet recording apparatus for recording on a recording medium using an ink jet recording head that records by discharging ink from ink discharge ports thereof. The ink jet recording apparatus includes a carriage that carries the ink jet recording head and reciprocally moves the head in a manner such that the recording head is opposite the recording medium, and the carriage includes a temperature stabilization portion contactable with the ink jet recording head carried on the carriage, wherein the temperature stabilization portion radiates heat generated by the ink jet recording head.

29 Claims, 15 Drawing Sheets

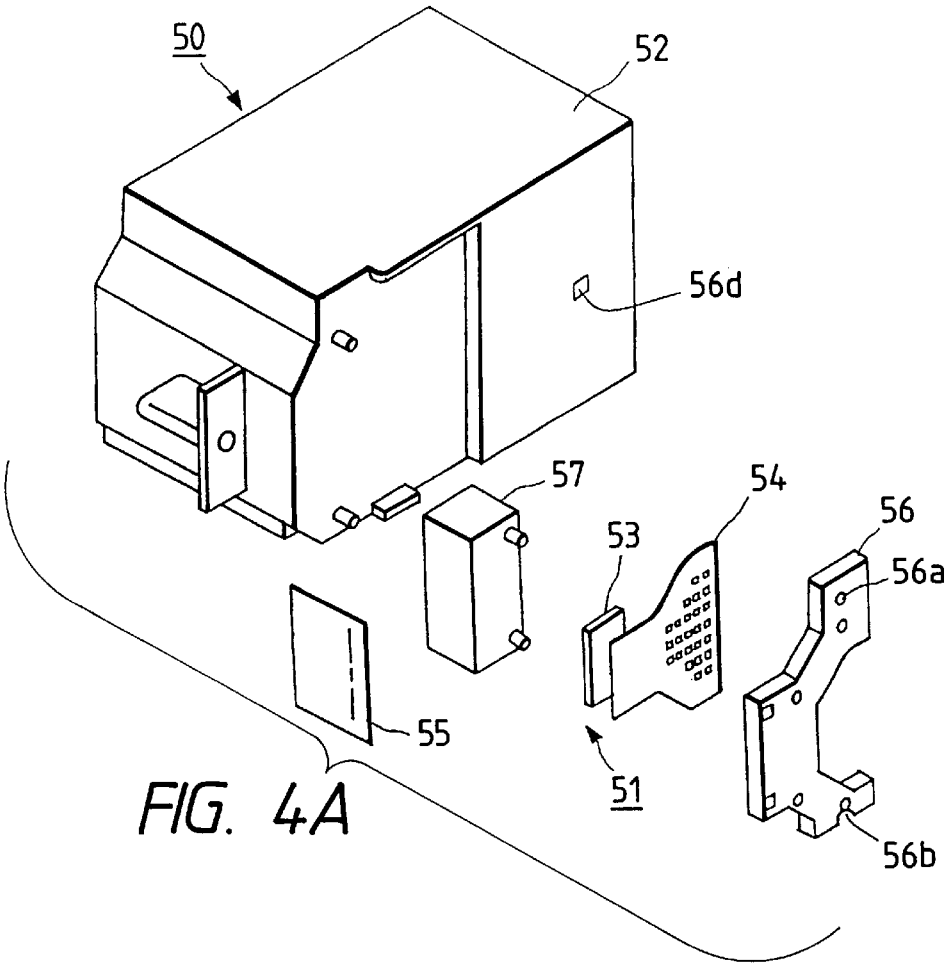
FIG. 4A
FIG. 4B
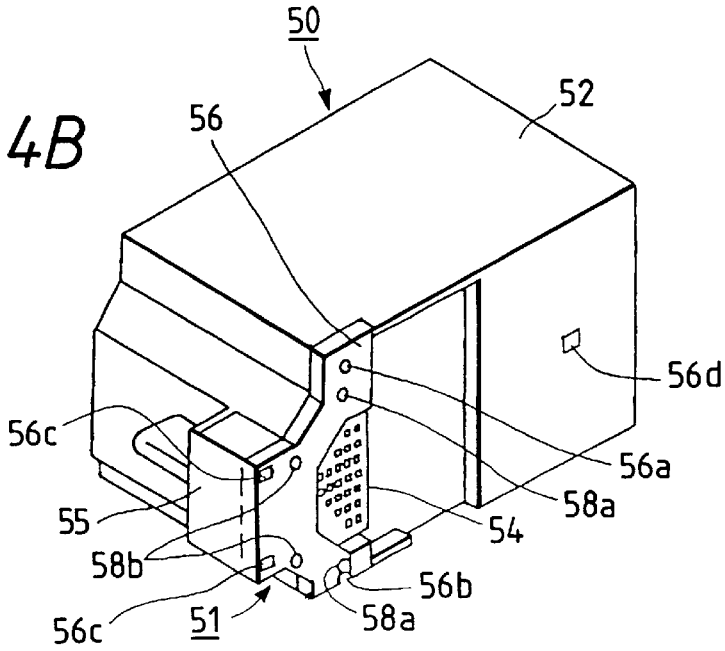

RECORDING APPARATUS INCLUDING RECORDING HEAD AND TEMPERATURE STABILIZATION PORTION

BACKGROUND OF THE INVENTION

1. Field of the Invention

The present invention relates to an ink jet recording apparatus for forming image information such as an ink image onto the recording medium such as a recording sheet or a plastic sheet using the ink, and more particularly to stabilization of the temperature of a head member which is carried on said ink jet recording apparatus.

2. Related Background Art

Recording apparatuses having the features of printer, copying machine and facsimile, or employed as the output device for the composite electronic equipment or workstation containing a computer, a word processor and so on, are configured to record the image onto the recording medium such as a paper or a plastic thin plate based on image information. Such recording apparatuses can be classified into an ink jet system, a wire dot system, a thermal system, and a laser beam system, according to the recording method.

Among the above-cited recording apparatuses, a recording apparatus adopting the ink jet system (ink jet recording apparatus), which performs the recording by discharging the ink from recording means (recording head) onto the recording medium, has the advantages that recording means can be made compact, the high definition image can be recorded at high speed, the ordinary paper is usable for recording without needs of any special treatment, the running cost is lower, there is less noise owing to the non-impact method, and the color image is easy to record by using the color ink. In particular, a line-type recording apparatus employing recording means of line type where a number of discharge ports are arranged in a direction of sheet width allows the faster recording to be effected.

Specifically, recording means (recording head) of the ink Jet system of discharging the ink by the use of heat energy can be easily fabricated with an arrangement of liquid channels (discharge ports) at high density by forming electrothermal converters, electrodes, liquid channel walls, and a ceiling plate as the film on a substrate through a semiconductor fabrication process including etching, vapor deposition and sputtering, and thus the apparatus can be made more compact. It is noted that the electrothermal converters are usually supported on a metallic support plate (base plate), and secured at respective predetermined locations. The base plate also serves as the heat sink to radiate the heat generated in the recording head.

In recent years, however, the high speed data processing has been allowed owing to the higher speed of CPU and the greater capacity of memory, resulting in the increased amount of discharging the ink per unit time (hereinafter referred to as duty). That is, the energy entered into the conventional recording head per unit time is steadily increasing because of the higher discharge frequency or more nozzles required for the faster recording, as well as the greater recording duty owing to the color recording or graphic recording associated with the replenished software environment (OS, application), resulting in increased calorific power from the recording head. When the temperature of this recording head is elevated beyond a certain value, there was a risk that the recording head might be degraded on the performance, as well as on the safety, resulting in lower recording quality.

To overcome the above-described problem, it is considered that the base plate attached to the recording head and also serving as the heat sink is made larger, but it is difficult to realize from the respects of increased cost, the ecology (larger consumption goods, or larger parts which are less reproducible), and the larger apparatus, resulting in a problem that the requirements for the faster recording and the color recording in the future are difficult to deal with.

SUMMARY OF THE INVENTION

It is an object of the present invention to provide an ink jet recording apparatus which can deal with the greater amount of calorific power associated with the increased amount of discharging the ink which may be brought about by more nozzles, the higher discharge frequency, and the color recording.

It is another object of the present invention to provide an ink jet recording apparatus comprising carrying means for carrying recording means for recording by discharging the ink in accordance with the signal, carrying means having heat radiation means for transferring and radiating the heat generated by recording means.

It is another object of the present invention to provide an ink jet recording apparatus comprising scanning means which is reciprocated in predetermined directions with recording means for recording by discharging the ink in accordance with the signal mounted freely detachably, the scanning means having heat radiation means for transferring and radiating the heat generated by recording means.

It is a further object of the present invention to provide an ink jet recording apparatus for performing the recording onto the recording medium using ink jet recording means for recording by discharging the ink, comprising carrying means for carrying the ink jet recording means to be opposable to the recording medium, and temperature stabilization means provided on said carrying means which can be brought into contact with the ink jet recording means carried on the carrying means, the temperature stabilization means radiating the heat of the ink jet recording means.

BRIEF DESCRIPTION OF THE DRAWINGS

FIGS. 4A and 4B are typical perspective views of the recording head for use with the present invention, wherein FIG. 4A is a typical perspective view in an exploded state, and FIG. 4B is a typical perspective view in an assembled state.

FIGS. 5A and 5B are typical outer views of the recording apparatus as shown in FIGS. 4A and 4B, wherein FIG. 5A is a typical left side view, FIG. 5B is a typical front view.

FIGS. 6A and 6B are typical front views of a carriage unit E in the first example of the invention, wherein FIG. 6A shows the state in which a recording head 50 is spaced apart from a side plate 60*b* of a carriage, and FIG. 6B shows the state in which the recording head 50 is abutted against the side plate 60*b* of the carriage.

FIGS. 15A and 15B are typical constitutional views of a carriage unit E of a recording apparatus in an eighth example of the invention, wherein FIG. 15A is a schematical front view and FIG. 15B is a cross-sectional view taken along the line 15B—15B in FIG. 15A.

DETAILED DESCRIPTION OF THE PREFERRED EMBODIMENTS

The embodiments of the present invention will be described below.

(FIRST EXAMPLE)

Figure 1:
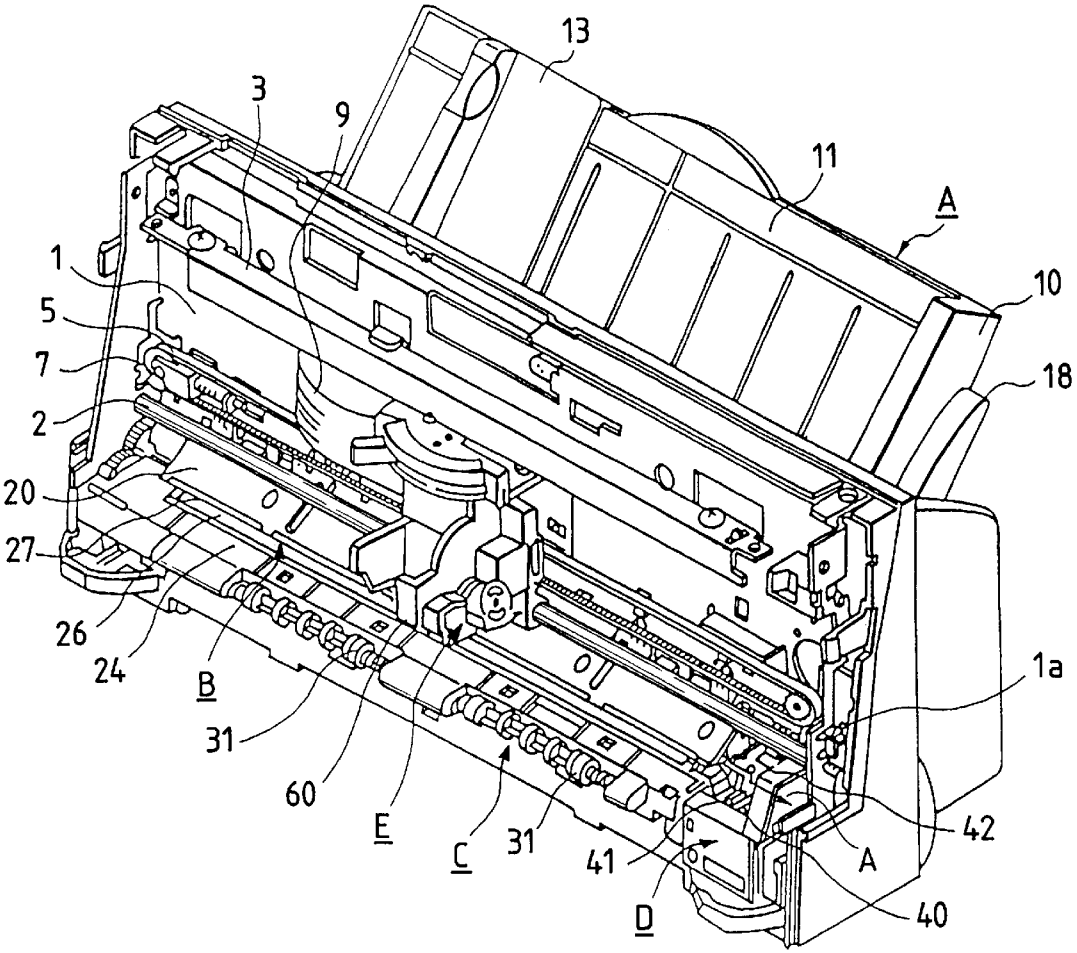
FIG. 1 is a typical perspective view showing the overall constitution of a recording apparatus in a first example of the present invention.
Figure 2:
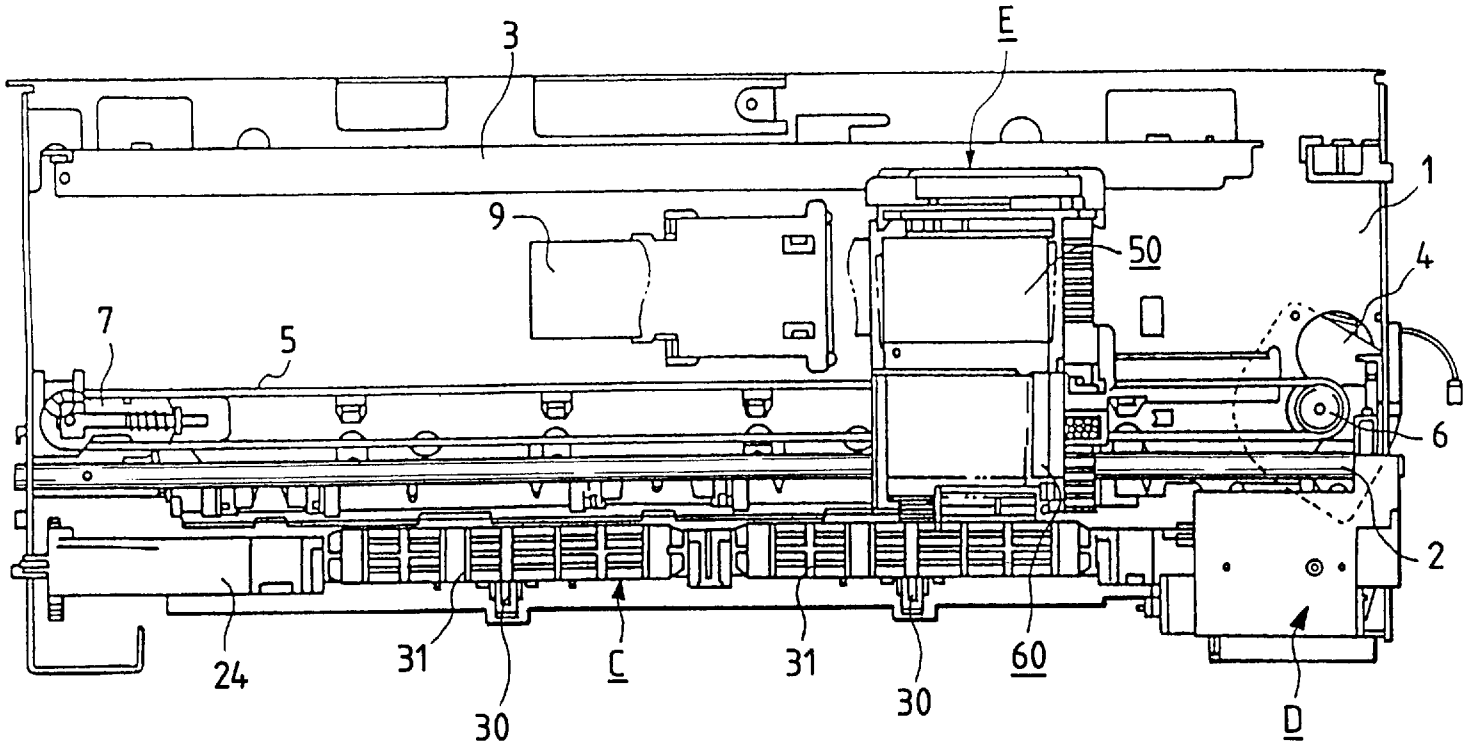
FIG. 2 is a typical front view of the recording apparatus as shown in FIG. 1.
Figure 3:
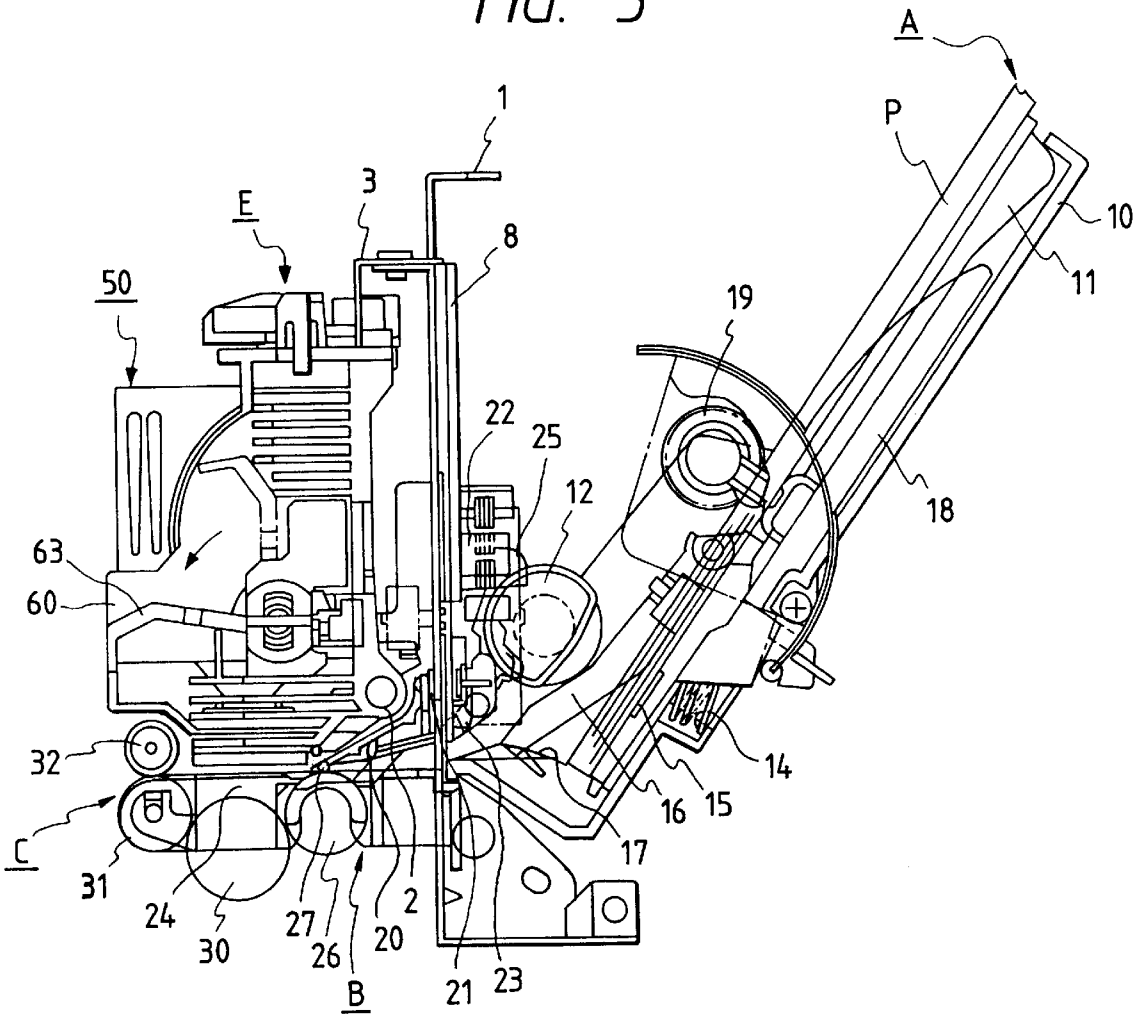
FIG. 3 is a typical constitutional cross-sectional view of the recording apparatus as shown in FIG. 1.

FIG. 1 is a typical perspective view showing the overall constitution of a recording apparatus in a first example of the present invention. FIG. 2 is a typical front view of the recording apparatus as shown in FIG. 1, and FIG. 3 is a typical constitutional cross-sectional view of the recording apparatus as shown in FIG. 1. The recording apparatus of this example is an ink jet recording apparatus of the serial type, which is essentially comprised of a paper supply unit A, a paper conveying unit B, a paper exhausting unit C, a cleaning unit D and a carriage unit E.

Thus, each of these units will be schematically described below.

(1) Paper supply unit

The paper supply unit A is configured to have a pressure plate 11 for loading the sheet P (recording paper or plastic sheet) as the recording medium and a supply body of revolution 12 for supplying the sheet P, which are attached to a base 10. The pressure plate 11 is provided with a movable side guide 13 to regulate the loading position of the sheet P. The pressure plate 11 is rotatable around a rotational shaft connected to the base 10, and is biased toward the supply body of revolution 12 by a pressure plate spring 14. Provided on the pressure plate 11 confronting the supply body of revolution 12 is a separating pad 15 made of a material having a large frictional coefficient such as an artificial leather to prevent the sheet P from moving under the gravitational force.

Further, disposed on the base 10 is a separation claw 16 for separating the sheet P one by one by taking hold of the corner portion of the sheet P in one direction. Also, a bank portion 17 for separating the recording medium such as a cardboard for which the separating claw 16 is unusable is formed integrally with the base 10, and a switch lever 18 for switching the separation claw 26 to take action in an ordinary paper position and take no action in a cardboard position and a release cam 19 for releasing the contact between the pressure plate 11 and the supply body of revolution 12 are provided.

In the above constitution, the release cam 19 forces the pressure plate 11 upward to a predetermined position in a standby state, so that the contact between the pressure plate 11 and the supply body of revolution 12 is released. And in this state, if a drive force exerted by a conveying roller 26 is transmitted via the gears not shown to the supply body of revolution 12 and the release cam 19, the release cam 19 leaves away from the pressure plate 11 to cause the pressure plate 11 to rise upward owing to a biasing force of the pressure plate spring 14, so that the supply body of revolution 12 and the sheet P are contacted, causing the sheet P to be picked up with the rotation of the supply body of revolution 12 to start the supply of a paper, the paper being separated one by one by the separation claw 16 and delivered to the paper conveying unit B. The supply body of revolution 12 and the release cam 19 rotate until the sheet P is delivered into the paper conveying unit B, thereby coming to the standby state again wherein the contact between the sheet P and the supply body of revolution 12 is released, and the driving force from the conveying roller 26 is cut off.

(2) Paper conveying unit B

The paper conveying unit B is comprised of a conveying roller 26 for conveying the sheet P and a PE sensor 22 for sensing the leading and trailing end of the sheet P. The conveying roller 26 is rotated by the driving of a motor (not shown), and is provided in contact with a pinch roller 27 which is driven for rotation. The pinch roller 27 is held on a pinch roller guide 20, and forced into contact with the conveying roller 26 by a biasing force of a pinch roller spring 21 to produce a conveying force for the sheet P. Further, at the entrance of the paper conveying unit 3 into which the sheet P is conveyed, an upper guide 23 for guiding the sheet P and a platen 24 are disposed. Also, the upper guide 23 is provided with a PE sensor lever 25 for sensing and informing the leading and trailing end of the sheet P to the PE sensor 22. Further, downstream of the conveying roller 26 in a sheet conveyance direction, a recording head 50 as recording means for recording onto the sheet P based on image information is provided. This recording head 50 will be described in detail later.

In the above constitution, the sheet P delivered into the paper conveying unit B is fed to a pair of rollers consisting of the conveying roller 26 and the pinch roller 27, guided by the platen 24, the pinch roller guide 20 and the upper guide 23. At this time, the PE sensor lever 25 senses the leading end of the sheet P fed, thereby to determine the recording position of the sheet P. Also, the pair of rollers 26, 27 are rotated by a driving force from a driving source (LF motor) not shown to convey the sheet P on the platen 24.

(3) Paper exhausting unit C

The paper exhausting unit C has a transmission roller 30 in contact with the conveying roller 26 and a paper exhausting roller 31 in contact with the transmission roller 30. Accordingly, a drive force of the conveying roller 26 is transmitted via the transmission roller 30 to the paper exhausting roller 31. Also, a spur 32 rotatable by being driven is provided in the paper exhausting roller 31. With the above constitution, the sheet P recorded at the recording position is conveyed by the roller pair comprised of the paper exhausting roller 31 and the spur 32 and is exhausted into a paper exhausting tray not shown out of the apparatus.

(4) Cleaning unit D

The cleaning unit D is comprised of a pump 40 for cleaning a head portion 51 of the recording head 50 (which is in the form of having integrally or separately an ink tank for storing the ink to be supplied to the head portion 51, or in the form of exchanging the ink tank only with the head portion left mounted to the carriage), a cap 41 for preventing drying of the head portion 51, and a drive switching arm 42 for switching the driving force from the conveying roller 26 for the transmission to the paper supply unit A and the pump 40.

This drive switching arm 42 fixes a planetary gear not shown rotatable around a shaft center of the conveying roller 26 at a predetermined position, except during the paper supply and cleaning operation, so that no driving force from the conveying roller 26 is transmitted to the paper supply unit A and the pump 40. If a carriage unit E as described below is moved to the position of the cleaning unit D, the drive switching arm 42 is moved in a direction of the arrow A to free the planetary gear, so that the planetary gear is moved in accordance with the forward or backward rotation of the conveying roller 26, whereby when the conveying roller 26 is rotated in a forward direction, the driving force is transmitted to the paper supply unit A, or when rotated in a backward direction, the driving force is transmitted to the pump 40.

(5) Carriage unit E

The carriage unit E has a head carrying unit for carrying or mounting detachably the recording head 50 as recording means for recording the image onto the sheet P. Herein, firstly the recording head 50 and then the carriage unit E will be described.

The recording head 50 as recording means records the ink image onto the sheet P which has been conveyed by the conveying unit B, and takes an ink jet recording system for performing the recording by discharging the ink from the head portion 51 (see FIGS. 4A and 4B) of the recording head 50 in this apparatus. That is, this head portion 51 comprises minute liquid discharge ports (orifices), the liquid channels and energy acting portions provided on the way of the liquid channels, and energy generating means for generating the liquid droplet forming energy to act on the liquid in the energy acting portions.

The energy generating means for generating such energy relies on a recording method of using electricity-stress converters such as piezoelectric elements, a recording method of using energy generating means for generating the heat by applying an electromagnetic wave such as a laser and discharging the liquid droplet under the action of generated heat, or a recording method of using energy generating means for heating the liquid with electrothermal converters such as heat generating elements having heating resistors to discharge the liquid.

Among them, a recording head for use with an ink jet recording method for discharging the liquid by the heat energy allows the recording at high resolution, because the discharge ports (orifices) for forming the discharging liquid droplet by discharging the liquid droplet for recording can be arranged at high density. Particularly, a recording head using electrothermal converters as energy generating means is easily subject to compactization, and permits full use of the merits of the IC technology or the micro-processing technology which have seen the remarkable technical advancements and increased reliability, with easy packaging at high density and low manufacturing cost, and thus is advantageous over the other methods.

Figure 5A:
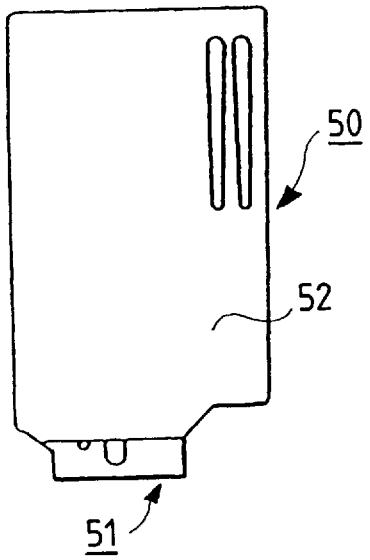
Figure 5B:
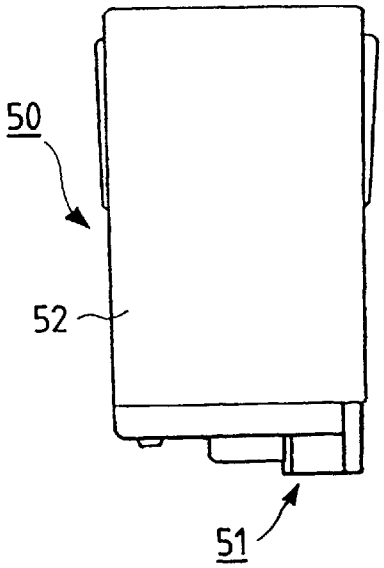
Figure 5C:
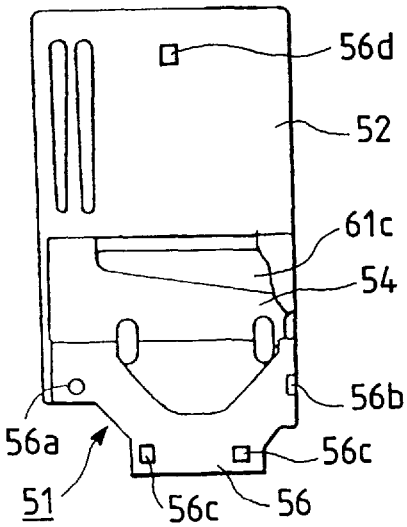
FIG. 5C is a typical right side view.
Figure 5D:
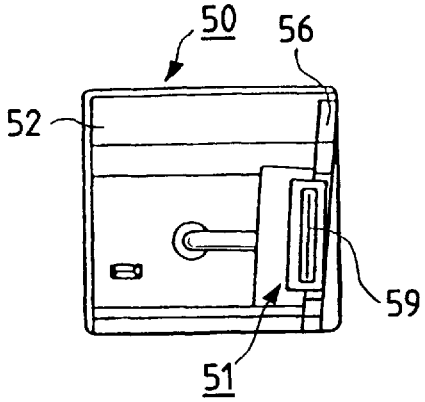
FIG. 5D is a typical bottom view.

FIGS. 4A and 4B are typical perspective views of a recording head which is applied to the present invention, wherein FIG. 4A is a typical perspective view in an exploded state and FIG. 4B is a typical perspective view in an assembled state. FIGS. 5A to 5D are typical outer views of the recording head which is applied to the present invention, wherein FIG. 5A is a left side view, FIG. 5B is a front view, FIG. 5C is a right side view, and FIG. 5D is a bottom view.

The recording head 50 as recording means has integrally a head portion 51 for discharging the ink in accordance with the signal from a control unit (not shown), and an ink tank 52 for storing the ink, shown in FIGS. 4A to 5D. In FIGS. 4A and 4B, 53 is a heater board, wherein the electrothermal converters (discharge heaters) and the wirings made of e.g. Al for supplying electric power to them are formed on an Si substrate by a film formation technology. 54 is a wiring substrate for the heater board 53, to which corresponding wirings are connected by, for example, wire bonding. 55 is a ceiling plate provided with the partition walls for forming the ink flow passageways and a common liquid chamber, this ceiling plate made of a resin material in this example. 56 is a base plate (support plate) made of metal (e.g., Al) having the fitting holes 56*a*, 56*b* which are positioning holes with respect to the carriage unit E, and can firmly secure the heater board 53, the wiring substrate 54 and a chip tank 57 sandwiched to the ink tank portion 52 with the welding portions 58*a*, 58*b*.

Also, with the above constitution, when discharging the ink, the ambient temperature is sensed by a thermistor (not shown) provided on a substrate of the main unit, and the measured temperature of the recording head is compensated for by a diode provided on the recording head 50.

And an optimal pulse width is given, in accordance with the recording head temperature, by the prediction control relying on the pulse width or number from the initial temperature, or the read value of the recording head temperature from the diode, to obtain a constant recording quality.

And when the recording head temperature rises above a certain temperature (e.g., 70° C.), the temperature is lowered by making a halt for a fixed time to prevent the breakage of the recording head, and further when a one-rank higher temperature (e.g., 100° C.) is attained due to exhaustion of the ink, the control is made so that the recording operation is stopped compulsorily by a judgement of abnormality, to produce the stable recording quality with the minimum damage by abnormality.

The carriage unit E has a carriage 60 for mounting the recording head 50 of the above constitution. The carriage 60 is supported by a guide shaft 2 for the reciprocation in the directions orthogonal to a conveying direction of the sheet P, and a guide rail 3 for maintaining a gap between the head portion 51 of the recording head 50 and the sheet P by taking hold of the trailing end of the carriage 60, as shown in FIGS. 1 to 3. Note that the guide shaft 2 and the guide rail 3 are attached to a chassis 1 for the main unit of the apparatus. Also, the carriage 60 is driven via a timing belt 5 by a carriage motor 4 attached to the chassis 1. This timing belt 5 is extended and supported by a motor pulley 6 and an idle pulley 7. Further, the carriage 60 is connected with a flexible cable 9 for transmitting a signal from an electrical substrate 8 on which a control unit is constructed to the recording head 50 mounted.

Accordingly, in forming the image on the sheet P, the recording head 50 is placed opposite an image forming position in such a way that a pair of rollers 26, 27 for the conveying unit B convey the sheet P to a row position at which the image is formed (a position in a conveyance direction of the sheet P), while the carriage 60 is moved to a column position at which the image is formed (in a direction perpendicular to the conveyance direction of the sheet P) by the carriage motor 4. Thereafter, upon a signal from the electrical substrate 8, the image is formed by discharging the ink from the nozzles 59 (see FIGS. 5A to 5D) of the head portion 51 of the recording head 50 onto the sheet P.

Figure 6B:
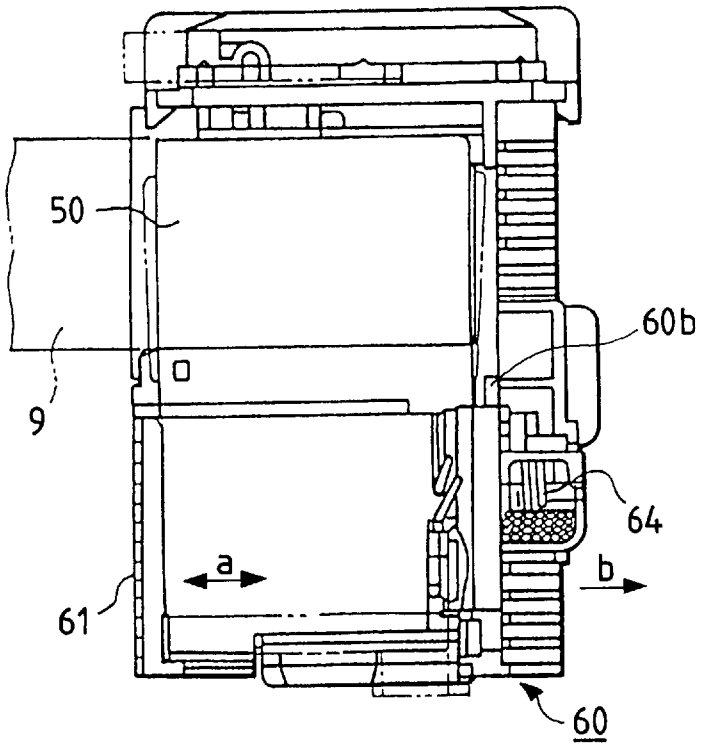
Figure 6A:
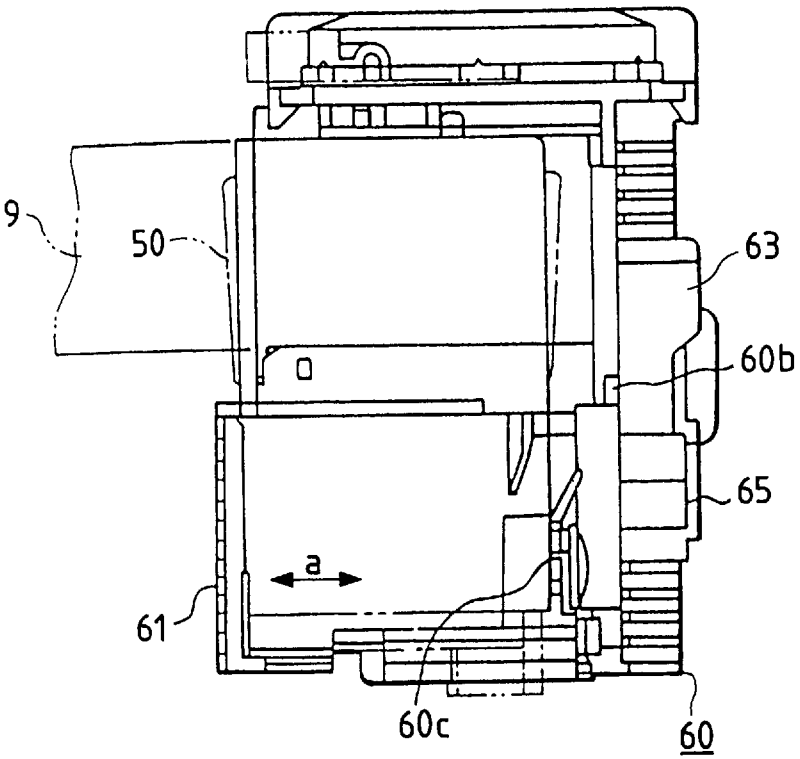
Figure 7:
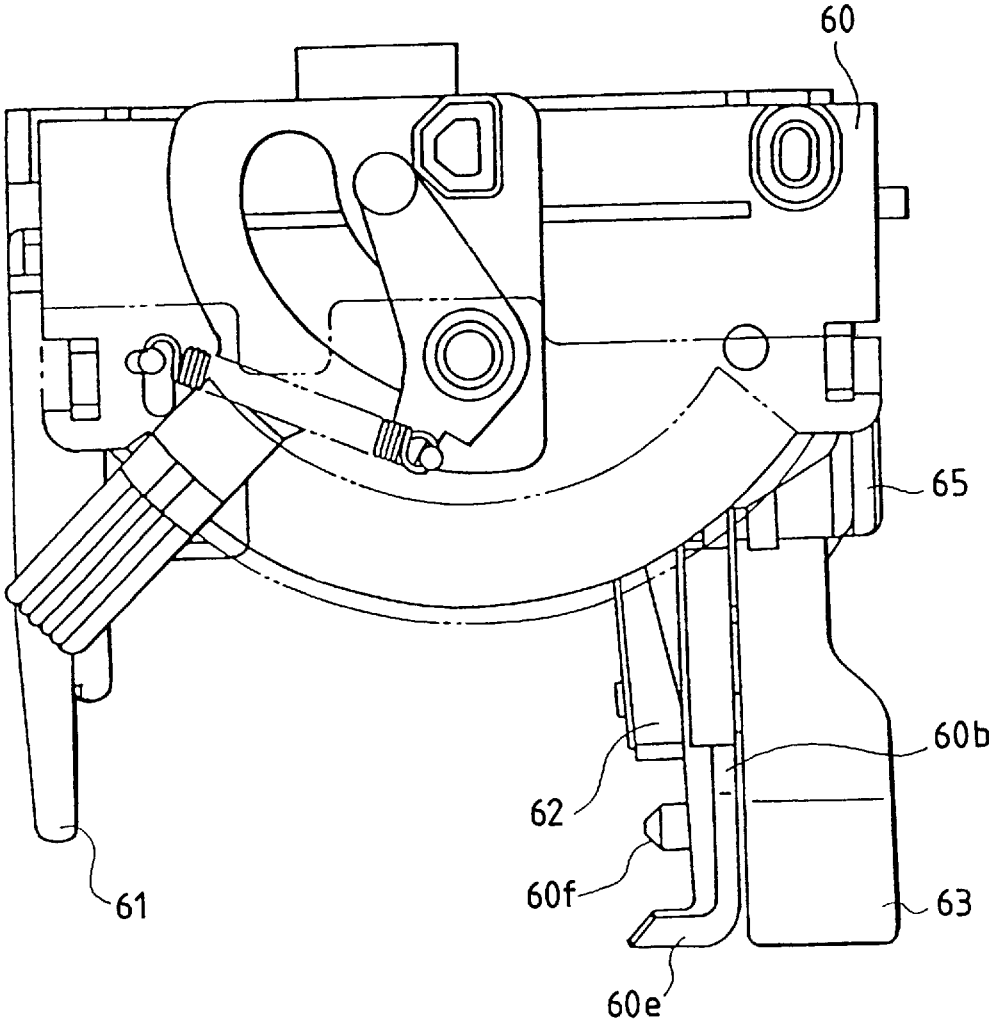
FIG. 7 is a typical plan view of the carriage unit E in the first example of the invention.
Figure 8:
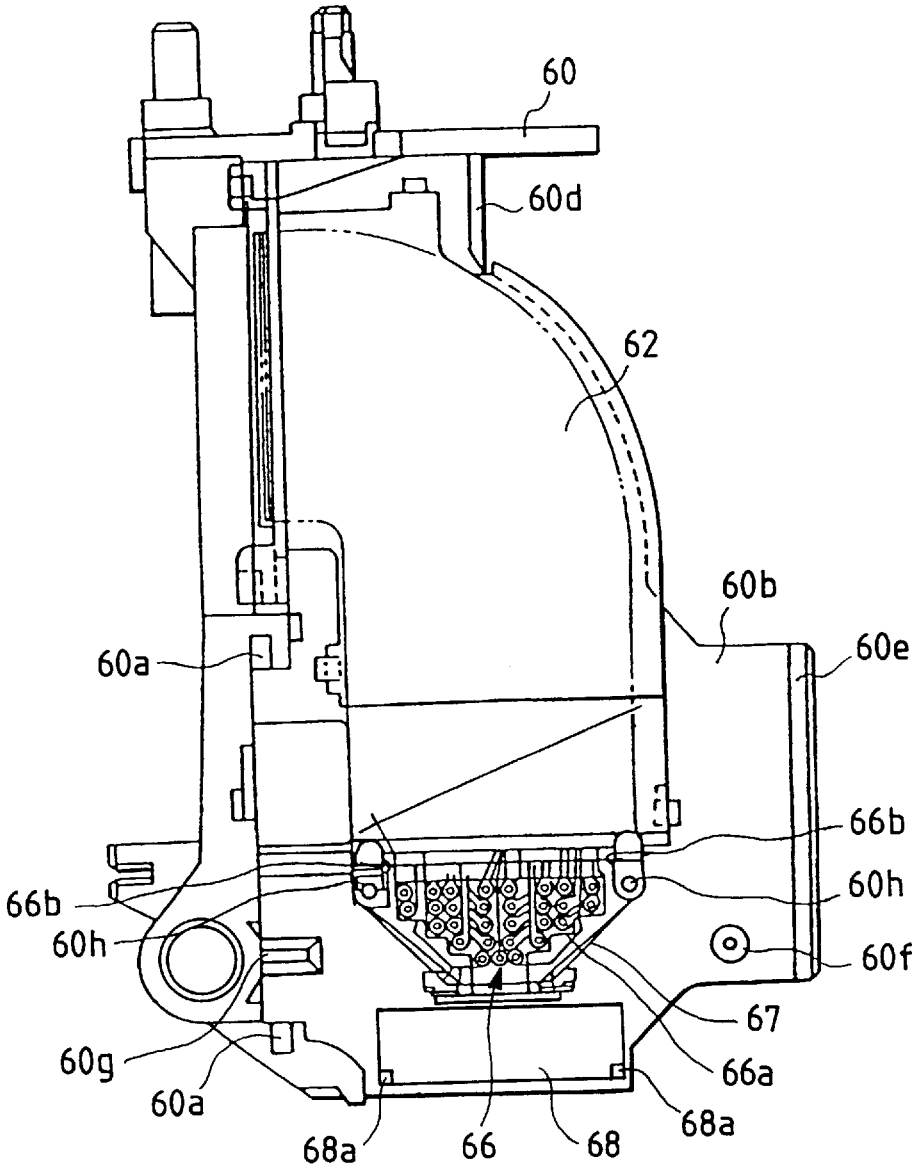
FIG. 8 is a typical constitutional view near a contact part of the carriage unit E in the first example of the invention.
Figure 9A:
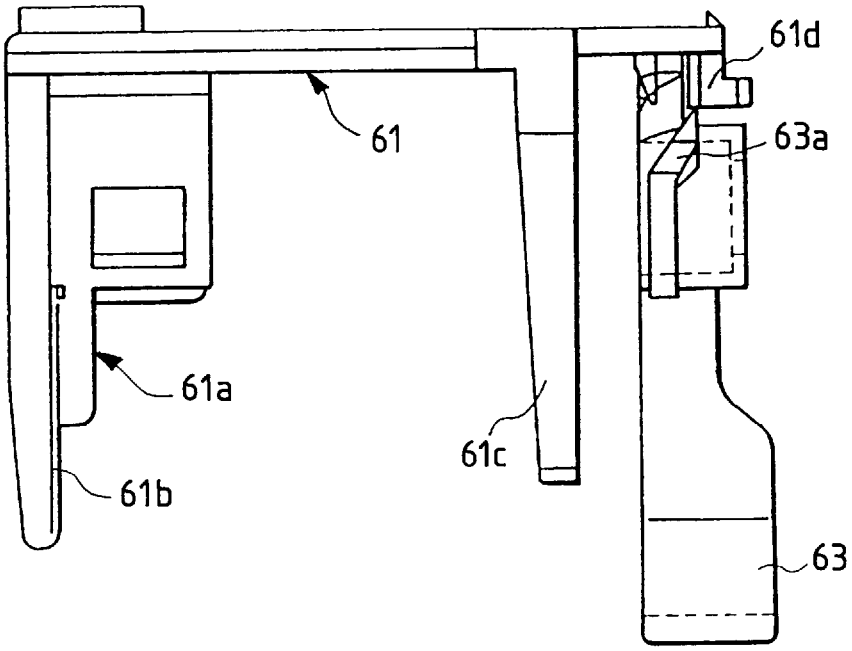
FIGS. 9A and 9B are typical constitutional views near a head holder of the carriage unit E in the first example of the invention.
Figure 9B:
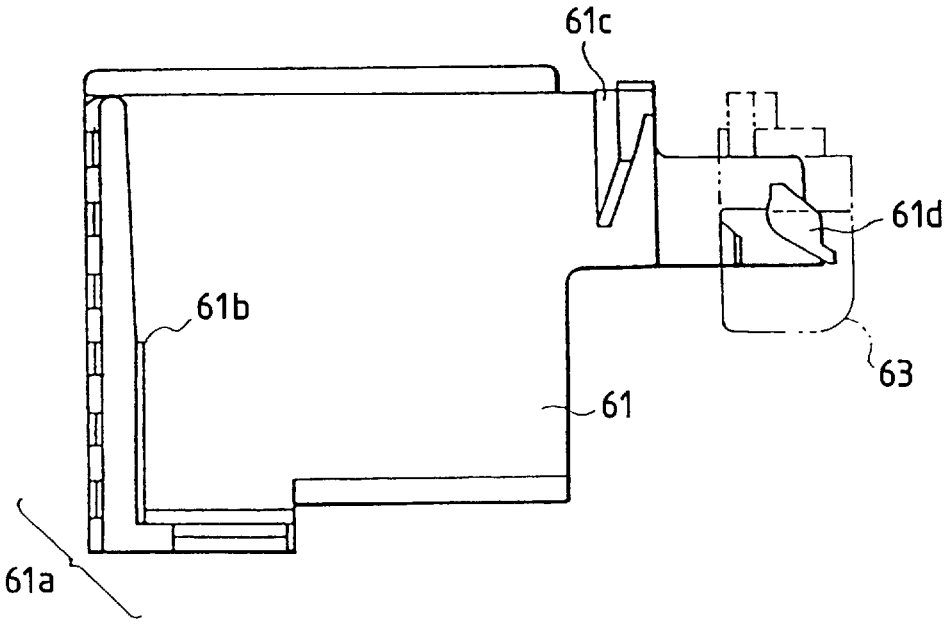
Figure 10:
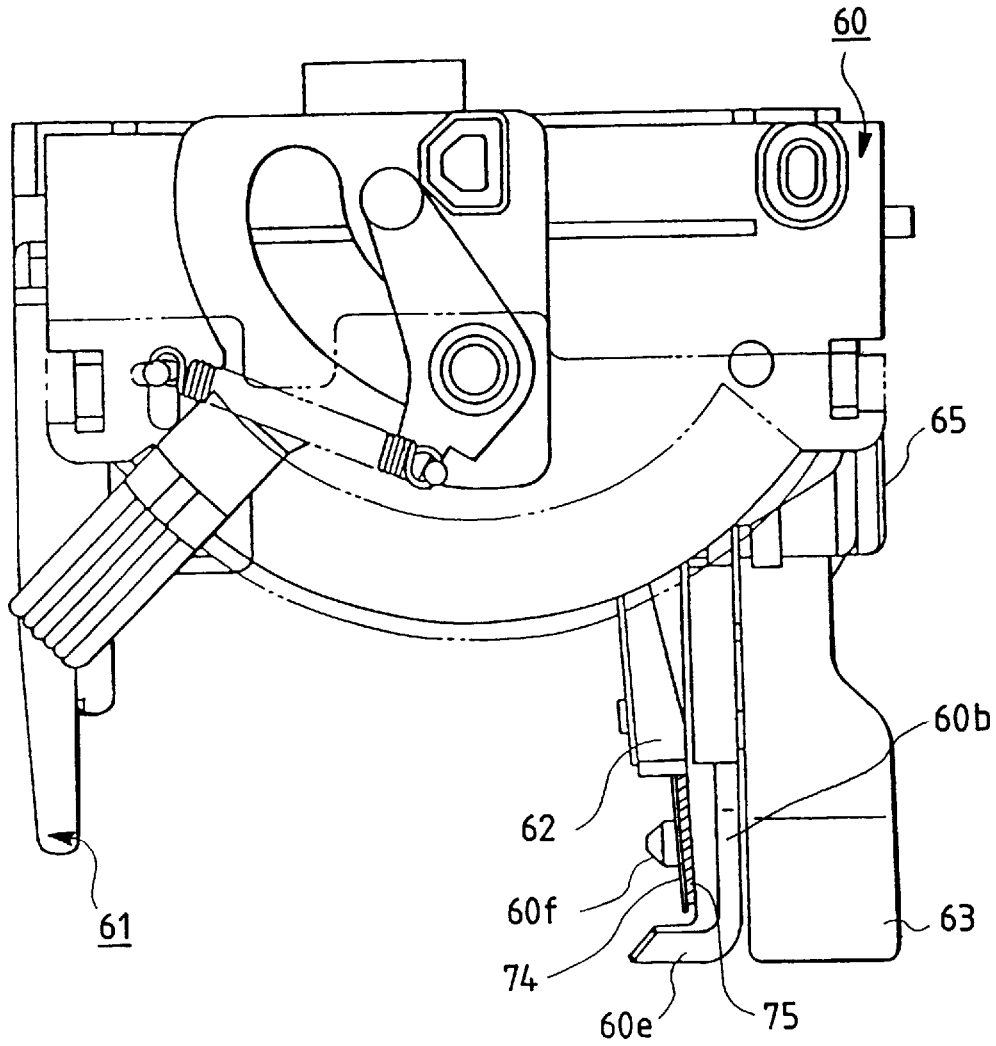
FIG. 10 is a typical plan view of a carriage unit of a recording apparatus in a second example of the present invention.

Next, the details of each of the main portions for the carriage unit E will be described below with reference to the drawings. FIGS. 6A and 6B are typical front views of the carriage unit E in a first example of the invention, wherein FIG. 6A shows the state where the recording head 50 is separated away from a side plate 60*b* of the carriage, and FIG. 6B shows the state where the recording head 50 is in contact with the side plate 60*b* of the carriage. FIG. 7 is a typical plan view of the carriage unit E in the first example of the invention, FIG. 8 is a typical constitutional view of a contact portion of the carriage unit E in the first example of the invention, and FIGS. 9A and 9B are typical constitutional views of a head holder of the carriage unit E in the first example of the invention.

The carriage unit E is a unit having each of the components attached to the carriage 60 which is integrally formed by a mold. This integral molding of the carriage 60 has the advantages that the manufacturing cost is lower than the casting, the lower cost is allowed by the reduced number of components, and the reduction in the load of the driving motor or the driving noise can be made by lighter weight.

In this carriage unit E, a mounting mechanism for the recording head 50 has a head holder 61, a base cover 62, a hook lever 63, a contact spring 64, a hook cover 65, a flexible substrate 66 connected to be electrically conductible with the flexible cable 9, a rubber pad 67, and a block 68 which is a heat sink member as temperature stabilizing means having the heat radiation/generation/accumulation function, all of which are attached to the carriage 60 integrally formed by molding.

As shown in FIGS. 6A to 9B, the head holder 61 has a recording head 50 mounted therein, and configured to be slidable along a guide 60*a* provided on the carriage 60 in the left and right directions (as indicated by the arrow a). The head holder 61 is provided with a guide portion 61*a* for guiding the recording head 50, and a pressing portion 61*b* for pressing the recording head 50 against a contact face 60*c* of the side plate 60*b* stood vertically on the carriage 60 and positioning surfaces 68*a*, 60*d*.

A two-point positioning surface 68*a* on the block 68 made of aluminum fitted into a centerboard portion of the carriage and a one-point positioning surface 60*d* provided on the side plate 60*b* of the carriage 60 are configured to correspond to a two-point reference plane 56*c* (see FIG. 5C) on the base plate 56 at the forward end of the head portion 51 for the recording head 50 and a one-point reference plane 56*d* (see FIG. 5C) above the lateral face at the rearward end of the ink tank 52 for the recording head 50, respectively.

The contact face 60*c* of the carriage 60 is arranged and configured to be located within a triangle which three points of the positioning faces 60*d*, 68*a* form. Likewise, the pressing position of the pressing portion 61*b* for the head holder 61 is also located within the triangle which three points of the positioning faces 60*d*, 68*a* form. Also, at an opposite position of the pressing portion 61*b* for the head holder is provided a guide arm 61*c*, and in separating the recording head 50 away from the contact surface 60*c*, this guide arm 61*c* is operated on the recording head 50. Also, on the side plate 60*b* of the carriage 60 is provided a rib 60*e* also used as the guide in mounting or separating the recording head 50, thereby protecting the contact portion 66*a* for the flexible substrate 66, as will be described later.

The hook lever 63 is rotatably attached to the side plate 60*b* of the carriage 60. A contact spring 64 is provided at the center of rotation of this hook lever 63 to bias the hook lever 63 in a direction away from the head holder 61 (as indicated by the arrow b in FIG. 6B). The hook cover 65 is attached to cover and hold a portion around the center of rotation for the hook lever 63 to prevent the hook lever 63 from being disengaged out of the carriage 60. Also, as shown in FIGS. 9A and 9B, the hook lever 63 and the head holder 61 have the cams 63*a*, 61*d*, which are contacted with each other, the head holder 61 being configured to be slidable in the left or right direction (as indicated by the arrow a in FIGS. 6A and 6B) by the rotation of the hook lever 63. Also, the biasing force of the contact spring 64 is a pressure force against the recording head 50 via the hook lever 63, a cam 63*a* and a cam 61*d*.

As shown in FIG. 8, the fitting pins 60*f*, 60*g* for the positioning of the recording head 50 are provided on the side plate 60*b* of the carriage 60, corresponding to the fitting holes 56*a*, 56*b* provided on the base plate 56 for the recording head 50, respectively.

Also, as shown in FIG. 8, a contact portion 66*a* of the flexible substrate 66 for making electrical contact with the wiring substrate 54 of the recording head 50, and a rubber pad 67 placed between the contact portion 66*a* and the contact face 60*c* for resiliently bringing the contact portion 66*a* into contact with the wiring substrate 54 of the recording head 50 are disposed on the contact face 60*c* provided on the side plate 60*b* of the carriage 60. The rubber pad 67 is made of an elastic material such as silicone rubber having a rubber hardness from 30 to 50 degrees. The flexible substrate 66 is connected via the flexible cable 9 to the electrical substrate 8 on the main unit of the apparatus.

The rubber pad 67 and the flexible substrate 66 are positioned by a positioning pin 60*h* provided on the side plate 60*b* of the carriage 60. Near the contact portion 66*a* of the flexible substrate 66 is provided a slit 66*b* to prevent deformation in assembling the flexible substrate 66 from affecting the contact portion 66*a*. Also, the top end of the contact portion 66*a* of the flexible substrate 66 is tapered in accordance with the shape of the base plate 56 for the recording head 50, with a hook portion not shown provided at the end portion. As shown in FIG. 8, by making the contact portion 66*a* of the flexible substrate 66 triangular and reducing the number of contact pads as the pads are closer to the top end, the forming of signal line is facilitated to realize the higher density.

Also, the block 68 having the two-point positioning face 68*a* as above described and serving as temperature stabilization means and as the heat sink member at the same time is fitted into a part on the side plate 60*b* for the carriage 60, whereby the heat transfer from the recording head 50 to the block 68 is enabled through the contacting of the positioning face 68*a* with the reference plane 56*c* provided on the base plate 56 for the recording head 50.

For example, the block 68 is configured to have the same heat capacity as the base plate, and an irregular shape with a sufficient surface area to be advantageous for the heat radiation, whereby in the general document (with an average duty per page of about 30% or less), the recording head 50 with 128 nozzles (70 or more nozzles), a (high) response frequency such as 10 kHz, and a print width (recording width) of 80 columns or more is enabled for the continuous recording without halt for a fixed time due to temperature elevation of the recording head as described in the section of the recording control.

Also, in mounting the recording head which has been left under the environmental condition (e.g., at the low temperature) which is different from that for the main unit of the recording apparatus, the heat which the block 68 retains is transferred from the block 68 to the recording head, allowing the recording head to be closer to the ambient temperature more rapidly.

In this way, since the temperature elevation of the recording head 50 is suppressed by the mounted block 68, the continuous recording is not only allowed, but also a more powerful force for making the recording head closer to the ambient temperature is exerted, so that there is less error in the recording control, and the excellent recording quality can be efficiently obtained.

Also, the heat capacity of the block 68 can be set in accordance with the number of nozzles for the head, the response frequency, the recording width of the recording apparatus, and the usage of recording (print duty mainly used), whereby the apparatus can be constituted with less waste in accordance with the usage of the apparatus.

Also, the block 68 and a variety of kinds of blocks or heat sinks in the embodiments as described below may be made of a variety of metals or other heat conductive materials, without being not limited to Al.

(SECOND EXAMPLE)

This example is an ink jet recording apparatus wherein a heat sink 74 as heat radiating means for transferring and radiating the heat generated in a recording head (head cartridge) is attached on a part of a side plate 60*b* of a carriage 60. The same numerals are employed to indicate the same components as in the first example.

Figure 11:
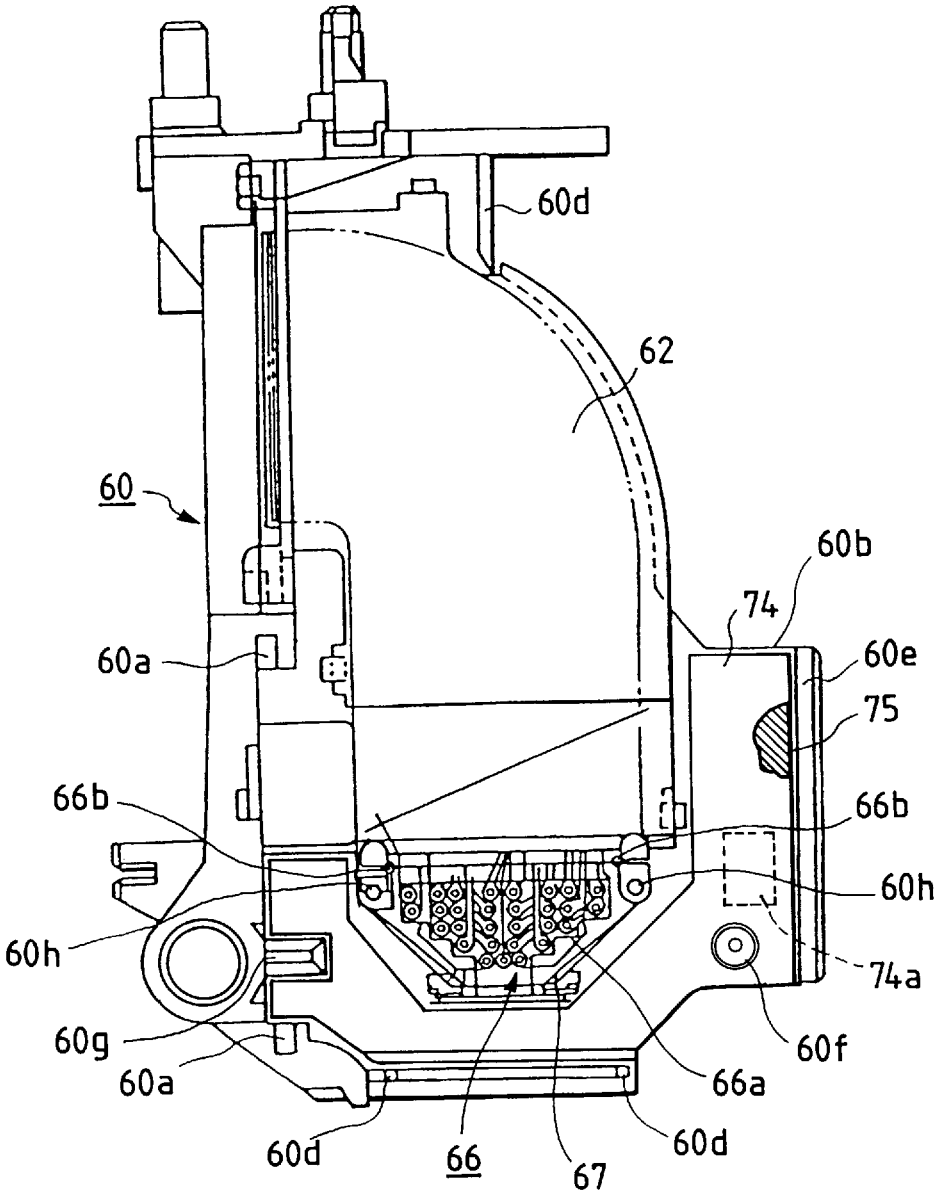
FIG. 11 is a typical constitutional view near a contact part of the carriage unit E for the recording apparatus in the second example of the invention.

Note that a positioning surface 60*d* of the side plate 60*b* for the carriage 60 has three points as shown in FIG. 11, which correspond to two points on a base plate 56 at the top end of a head portion 51 for the head cartridge 50, and one point above the rearward end of an ink tank 52 for the head cartridge 50, respectively.

This heat sink 74 is composed of a material having a surface area and a heat capacity necessary to effect the radiation in accordance with the characteristics of the head cartridge 50 mounted, and is configured to be movable in a direction where the fitting pins 60*f*, 60*g* for the carriage 60 and the fitting holes 56*a*, 56*b* for the head cartridge 50 are fitted by a rubber member 69 disposed on the back side. Thereby, the heat sink 74 is brought into firm contact with the base plate 56 for the head cartridge 50 mounted, so that the heat generated in the head cartridge 50 is transferred via the base plate 56 to the heat sink 74 and radiated.

Further, the heat sink 74 has a portion thereof extending through the side plate 60*b* of the carriage 60 to the back side to form a projection portion 74*a*, which can enhance heat radiation effect by the contact with the outside air, when the carriage E is reciprocated, or effect radiation by the contact with a grounding portion 1*a* which is a part of a metallic chassis 1 for the main unit of the apparatus, when the carriage E returns to a home position.

While the above constitution, the mounting, holding, positioning, and electrical contact of the head cartridge 50 with the carriage E are effected by the operation of hook lever 63, while the base plate 56 of the head cartridge 50 is brought into firm contact with the heat sink 74 provided on the side plate 60*b* of the carriage 60, so that the heat generated in the head cartridge 50 can be transferred to the heat sink 74 on the carriage 60 and radiated.

(THIRD EXAMPLE)

Figure 12:
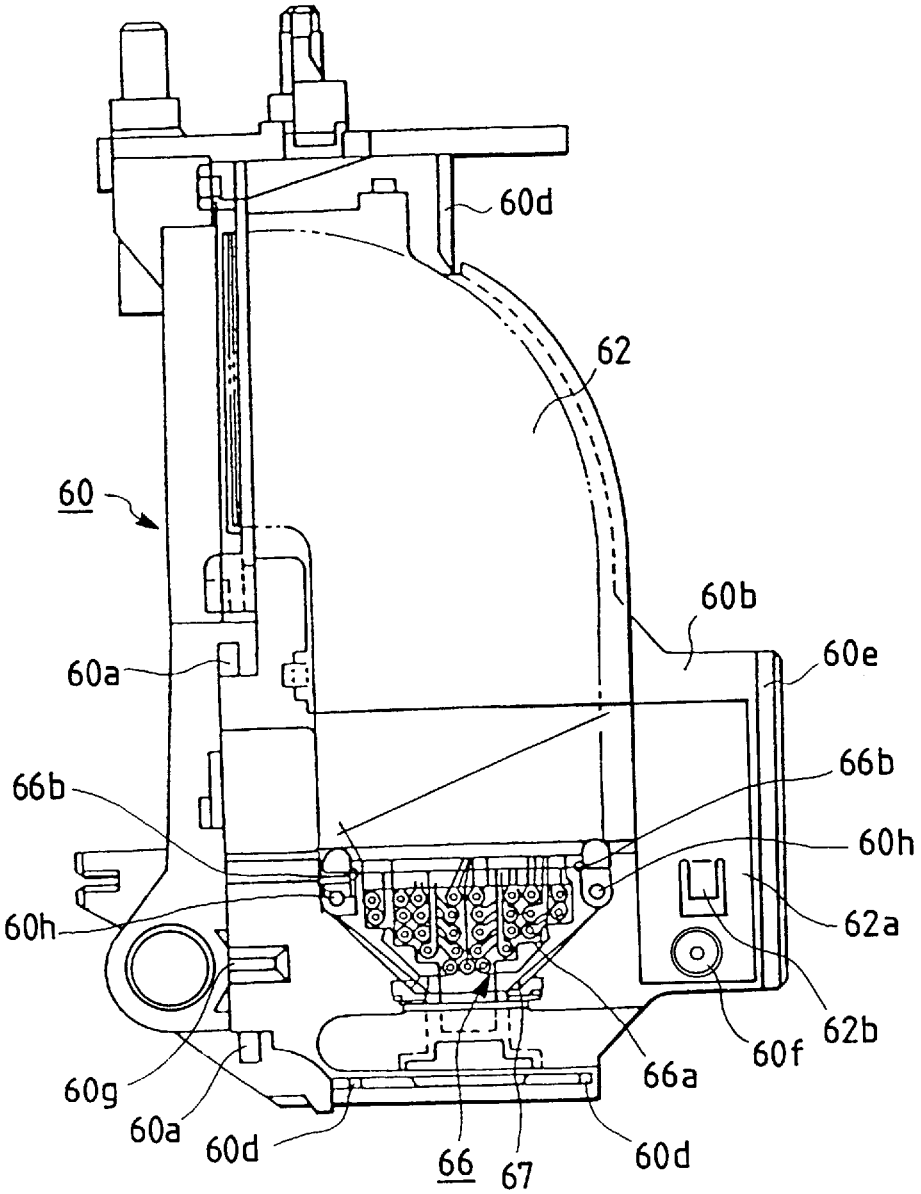
FIG. 12 is a typical constitutional view of a carriage unit E of a recording apparatus in a third example of the present invention.

While in the second example as above described, the heat sink 74 as heat radiation means is disposed on the side plate 60*b* of the carriage 60, the present invention is not limited thereto and may be configured to comprise a component built into the carriage 60 of the carriage unit E as heat radiation means. For example, the base cover 62 which is a component built into the carriage 60 of the carriage unit E may be made of a material having a high heat conductivity, and the contact portion 62*a* of the base cover 62 which can make contact with the base plate 56 for the head cartridge 50 may be bent toward the side plate 60*b* to form a spring portion 62*b*, as shown in FIG. 12. By this constitution, the base plate 56 of the head cartridge 50 and the base cover 62 as heat radiation means on the carriage unit E are brought into firm contact to transfer and radiate the heat generated on the head cartridge 50 via the base plate 56 to the carriage unit E. Further, according to this example, the same effects as in the previous examples can be not only obtained, but also the cost can be reduced owing to the reduced number of components.

(FOURTH EXAMPLE)

Figure 13:
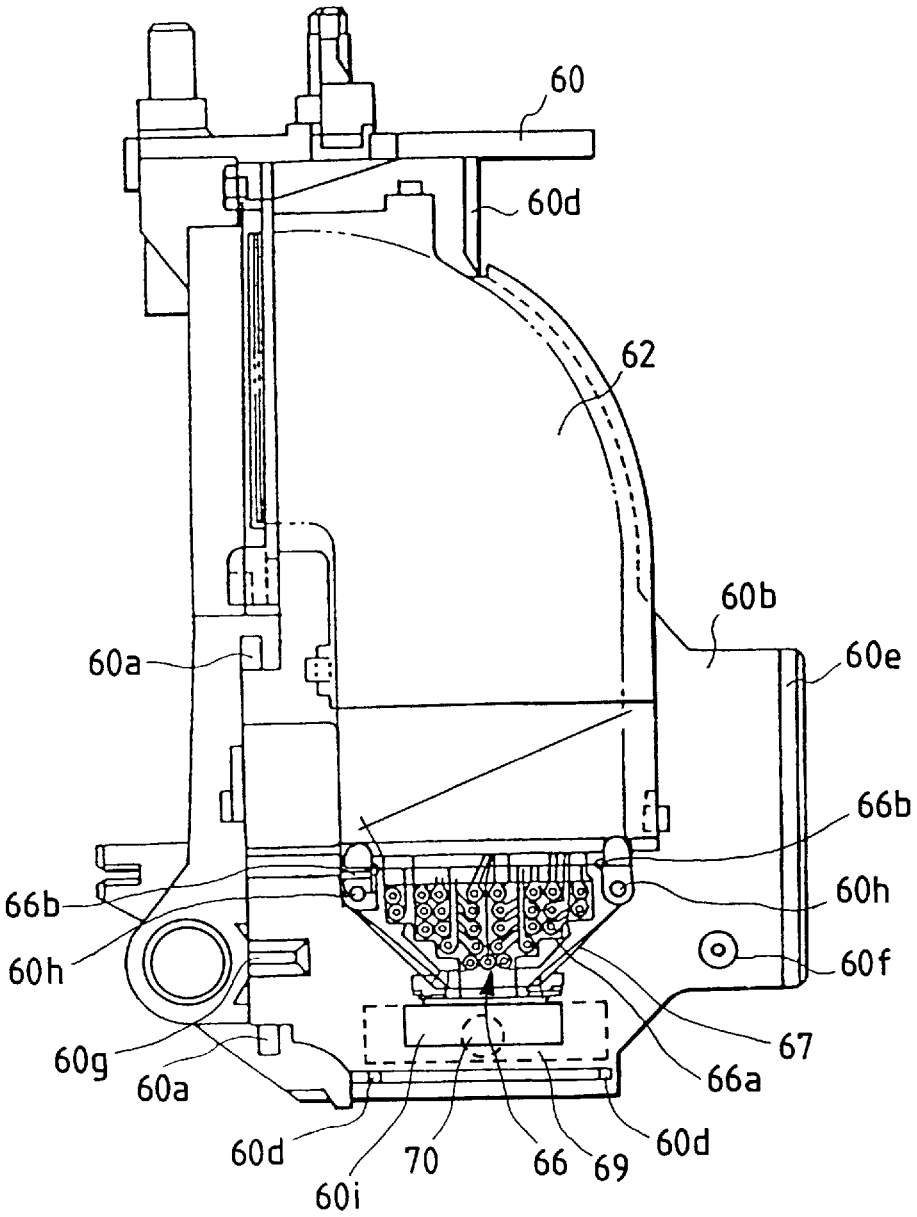
FIG. 13 is a typical constitutional view near a contact part of a carriage unit E in a fourth example of the invention.

FIG. 13 is a typical constitutional view of a contact portion of a carriage unit E in a fourth example of the invention. While in the first example as previously described, the block 68 which can act as the heat sink as heat radiation means and concurrently as temperature stabilization means is disposed on the side plate of the carriage, with a portion thereof serving as the positioning face, the present invention is not limited thereto, and may be configured such that the positioning face 60*d* with the recording head is provided independently on the side plate 60*b*, the block 69 being movable with respect to the side plate 60*b* and biased toward the recording head which makes contact therewith by an elastic member such as a spring, as shown in FIG. 13.

In FIG. 13, 69 is a block made of a material having a high heat conductivity such as aluminum, wherein the contact surface of the recording head with the base plate is smooth, and biased toward the recording head (the forward side on the paper face) by a compression spring 70. At this time, the contact portion of the block 69 with the recording head penetrates through a window portion 60*i* of the side plate 60*b* for the carriage from a face of the side plate opposite the recording head to be in contact with the recording head, and since the width of a non-penetration portion of the block 69 is formed to be greater than the width of the window portion 60*i* of the side plate 60*b* for the carriage, a frame of the window portion of the side plate 60*b* for the carriage serves as a stopper to prevent the block 69 from falling off in the recording head side. Also, a contact face of the block 69 with the base plate of the recording head, though not shown, is similarly smooth.

Since the contact face of the block 69 with the base plate of the recording head can be smooth owing to no provision of the positioning surface, and the contact face of the block 69 with the base plate of the recording head is likewise smooth, the contact face area will increase if the contact face of the block 69 is urged to make the entire surface contact, and since this contact face is a true back side of the heater board 53 of the heat generation source as shown in FIGS. 4A and 4B for the first example, the generated heat is efficiently transferred to the block 69, further suppressing the temperature elevation of the recording head.

In this way, according to this fourth example, if the block 69 which is temperature stabilization means as well as heat radiation means is made movable in a direction of coming into contact with the recording head 50, and the block 69 is biased by biasing means, a stable contact pressure can be obtained between the block 69 and the recording head 50 (between heat radiation means and the head member) to allow the increase in the heat transfer amount via the contact face.

(FIFTH EXAMPLE)

Figure 14A:
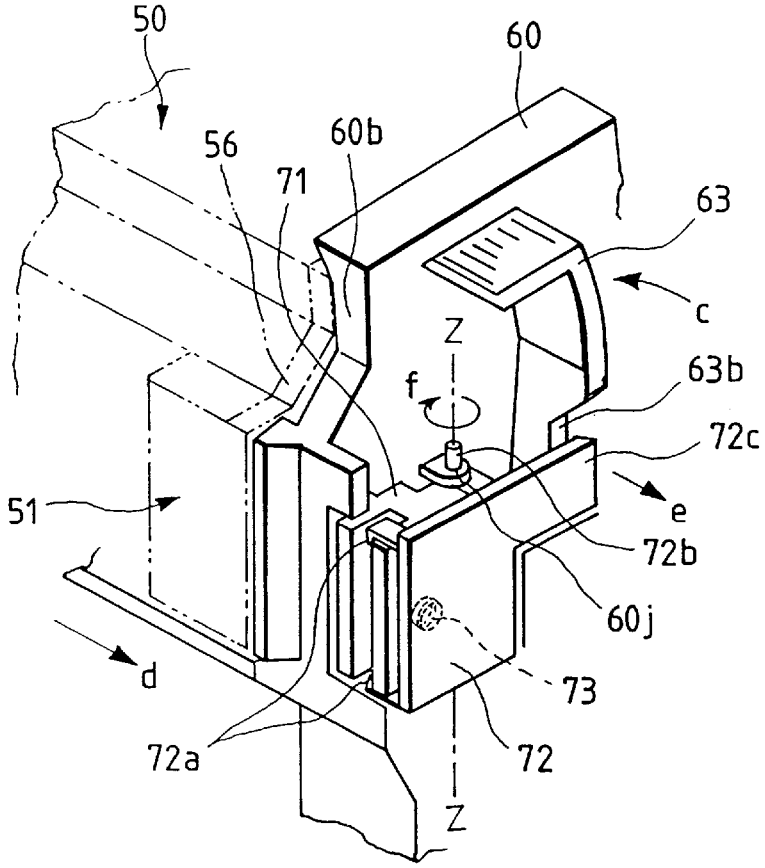
FIG. 14A is a typical perspective view for explaining the mounting of a head onto a carriage in a fifth example of the invention, and the contacting operation of a block with the head.
Figure 14B:
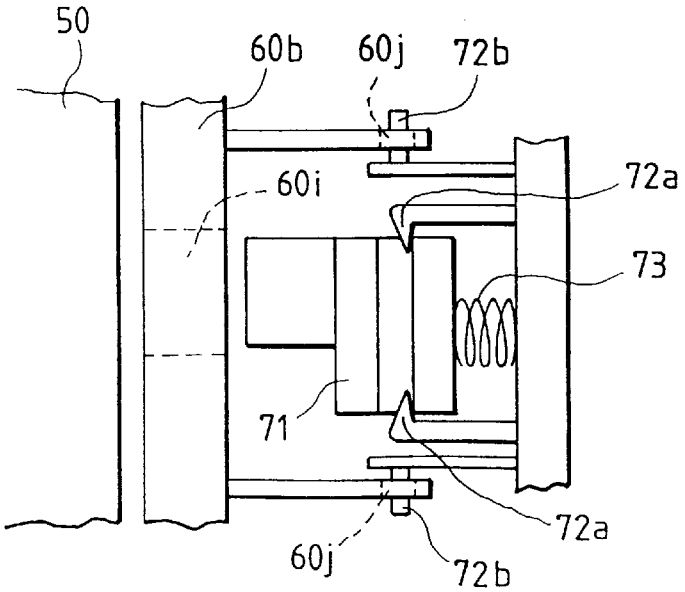
FIG. 14B is a typical front view of FIG. 14A.

FIGS. 14A and 14B are explanation views of a fifth example of the present invention, wherein FIG. 14A is a typical perspective view showing the mounting of a head onto a carriage, and FIG. 14B is a typical front view thereof. In FIGS. 14A and 14B, 71 is a block as heat radiation means, which is movable by being biased toward the recording head 50 (a side plate 60*b* of the carriage 60) by a compression spring 73 as an elastic member interposed between the block 71 and a support member 72 supporting the block 71. At this time, the movement of the block 71 to the recording head 50 is restricted by a claw 72*a* as a movement restriction portion provided on the support member 72. Also, a shaft 72*b* of the support member 72 provided along the line Z—Z of FIG. 14A is supported rotatably through a support hole 60*j* provided laterally of the side plate 60*b* of the carriage 60. Thereby, the support member 72 is supported rotatably around a rotational axis of Z—Z on the side plate 60*b* of the carriage 60.

On the other hand, by a mounting mechanism of the recording head 50 on the carriage unit E as previously described and shown in FIGS. 9A and 9B, the recording head 50 is mounted at a predetermined position by coming into contact with a reference plane of the side plate 60*b* of the carriage 60 by a head holder 61 which can slide in a direction of the arrow d of FIG. 14A by operating a hook lever 63 in a direction of the arrow c of FIG. 14A.

At this time, the contact between the recording head 50 and the reference plane of the carriage side plate 60*b* occurs during a series of rotational operations for the hook lever 63. And by the series of rotational operations for the hook lever 63 following the contact between the recording head 50 and the reference plane of the carriage side plate 60*b*, a lever contact portion 63*b* of the hook lever 63 forces a lever portion 72*c* of the support member 72 in a direction of the arrow e of FIG. 14A. By the rotation of the support member 72 around a rotational axis of Z—Z caused by this in a direction of the arrow f of FIG. 14A, the block 71 is urged toward the side plate 60*b* of the carriage 60. Herein, the block 71 is configured as previously described with the fourth example, that is, such that a portion of the block 71 extending through the window portion 60*i* as an opening provided on the side plate 60*b* of the carriage 60 is brought into contact with the base plate 56 of the recording head 50.

At this time, the block 71 urged resiliently is of such a shape that it is restricted from moving to the carriage side plate 60*b* by a claw 72*a*, but is released from the restriction by the claw 72 upon the contact with the recording head 50.

Further, by appropriately selecting the shape of the block 71, the shape of the lever contact portion 63*b* for determining the contact timing between the lever contact portion 63*b* and the lever portion 72*c*, and the position of the shaft 72*b*, the contact between the block 71 and the recording head 50 will occur after the contact between the recording head 50 and the reference plane of the carriage side plate 60*b* has occurred.

In this way, according to this example, the mounting of the recording head 50 at a predetermined position of the carriage, and the contact of the block 71 as heat radiation means with the recording head 50 after mounting, can be accomplished by a series of rotational operations of the hook lever 63.

In the previously-described fourth example, the block is made movable with respect to the side plate of the carriage, and is biased toward the recording head by a spring, but the biasing force in this direction is opposite to the direction of the contact between the recording head and the reference plane of the carriage side plate, whereby there is a risk that the contact force with the head reference plane may weakened.

However, according to the constitution of the fifth example, when mounting the recording head, the block 71 is biased toward the head by the compression spring 73, but is restricted in its movement by the claw 72*a* of the support member, wherein by holding the contact face of the block 71 with the base plate at a position not beyond the reference plane of the carriage side plate, the block 71 does not obstruct the mounting of the recording head, and by operating the support member 72 with the hook lever 63 after the contact between the recording head 50 and the side plate reference plane, the block 71 is brought into contact with the base plate 56 fixed therein after the contact, while leaving from the claw 72*a* of the support member, thereby enabling the secure biasing under a constant pressure by the compression spring 73, so that in addition to the same heat transfer effect as that of the above-described example, the secure contact between the recording head and the side plate reference plane can be realized.

In this way, according to the fifth example, the block 71 as the heat radiation means as well as temperature stabilization means is made movable in a direction of coming into contact with the recording head 50 as the head member, and after the contact between the head member and the carriage 60 as the head holding member is completed, the heat radiation means and the head member are contacted, so that there is no other force acting on the head member to obstruct its mounting onto the head holding member, and after the mounting, the heat radiation means and the head member are contacted, whereby the mounting of the head member with the electrical connection can be securely made, and a stable contact pressure between the heat radiation means and the head member can be obtained, allowing the greater heat transfer amount via the contact face.

(SIXTH EXAMPLE)

In a sixth example as described below but not shown, the block is electrically connected to the Gnd line of a flexible cable (numeral 9 in FIG. 2) for transmitting a signal from the electrical substrate (numeral 8 in FIG. 3) having the control portion of this recording apparatus constructed to the recording head.

In addition to the heat radiation effect for radiating the heat from the recording head in the previously-described examples, the radiation of the heat from the recording head can be further promoted through the electric wire having a high heat conductivity, and the block and the main unit of the recording apparatus are electrically connected, whereby the breakage of the recording head due to static electricity in operating the hook lever can be prevented, for which there is no complex structure for electrically connecting the recording head to be mounted detachably to the main body of the recording apparatus.

(SEVENTH EXAMPLE)

In a seventh example as described below but not shown, a contact piece composed of a material having a high heat conductivity and a high electric conductivity provided on the block is slidably moved in contact with the metallic guide shaft (numeral 2 in FIG. 1) for reciprocating the carriage in the direction orthogonal to a conveyance direction of the sheet.

In addition to the heat radiation effect for radiating the heat from the recording head according to the first to fifth examples, the radiation of the heat from the recording head can be further promoted through the contact piece having a high heat conductivity, and the block and the main unit of the recording apparatus are electrically connected, whereby the breakage of the recording head due to static electricity in operating the hook lever can be prevented, for which there is no complex structure for electrically connecting the recording head to be mounted detachably to the main body of the recording head.

(EIGHTH EXAMPLE)

While in each of the previously-described examples, the heat sink or block as temperature stabilization means or heat radiation means is disposed on the carriage 60, or one component built into the carriage 60 of the carriage unit E is used, the present invention is not limited thereto, and may be configured such that, for example, the heat radiation means has a function as sensing means for sensing whether or not the head cartridge 50 mounted on the carriage unit E is present.

Figure 15A:
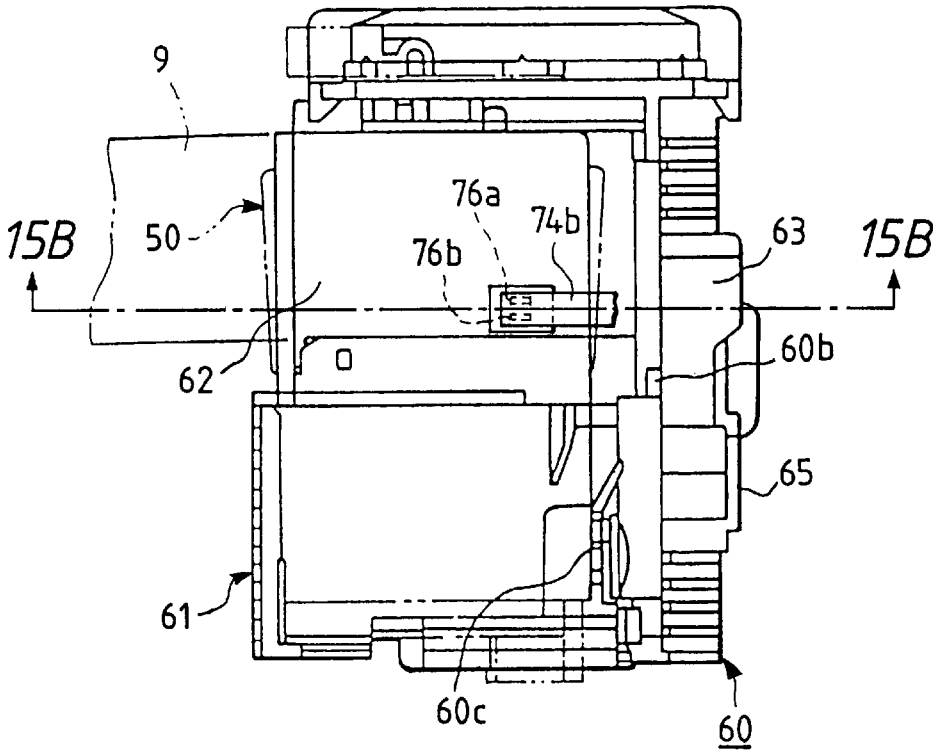
Figure 15B:
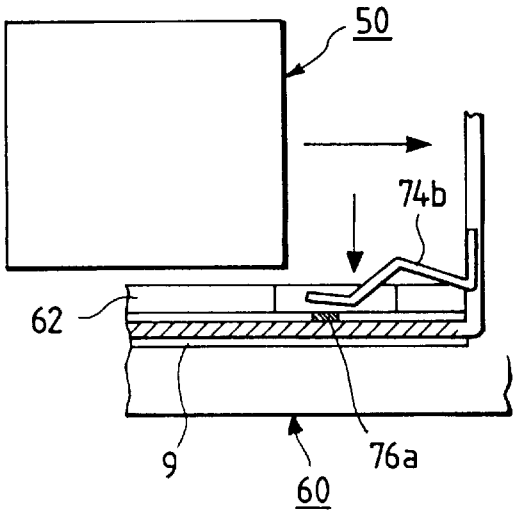

As shown in FIGS. 15A and 15B, the contact points 76*a*, 76*b* exposed partly on a flexible cable 9 built into the carriage 60 are provided, and the heat sink is provided in the same form as in the second example previously described, a part thereof as the contact portion 74*b* being disposed above and spaced away from the portion which becomes a position opposite the contact points 76*a*, 76*b*.

With the above constitution, if a head cartridge 50 is mounted on the carriage 60, the contact portion 74*b* of the heat sink 74 and the contact points 76*a*, 76*b* are contacted, while if the head cartridge 50 is disengaged, the contact portion 74*b* is separated away from the contact points 76*a*, 76*b*, whereby by measuring the resistance value between the contact points 76*a*, 76*b*, it is possible to determine whether or not the head cartridge 50 mounted on the carriage 60 is present. In this way, in this example, the same effect as in each of the previously-described examples can not only be obtained, but also it is possible to determine whether or not the head cartridge as recording means is present, which is important information in the recording control.

It should be noted that this example, like each of the previously-described examples, is not limited to the recording apparatus for mounting detachably the recording head and the ink tank integrated together on the carriage, but is likewise applicable to, for example, a recording apparatus with only the ink tank being replaceable.

(NINTH EXAMPLE)

While in the eighth example as described above, at the time when the head cartridge as recording means is mounted on the carriage, the heat sink provided on the carriage is brought into contact with the base plate of the head cartridge, the present invention may be configured such that, for example, when making minute temperature control of the head portion for the head cartridge, the temperature of the head portion is sensed by a thermistor or the like, and the heat sink may be brought into or out of contact therewith, in accordance with the temperature changes, by a driving mechanism with a solenoid or a shape memory alloy. With this constitution, the temperature elevation of the head can be not only prevented, but also the minute temperature control can be made. Also, by transferring the heat absorbed by the heat sink to the other portion, for example, the rear part of the ink tank (the remote position from the nozzles of the head), the temperature control of the ink within the ink tank can be made.

(TENTH EXAMPLE)

In a tenth example as described below but not shown, cooling means which uses a cooling element in the block, heating means which uses a heating element, and temperature sensing means which uses a thermistor are provided.

The output to cooling means and heating means is controlled to reach a preset temperature by control means separately provided, based on temperature information measured by temperature sensing means, so that the temperature of the block is managed to become the set temperature.

With this constitution, the temperature of the recording head which is brought into contact with the block is positively managed, whereby the fast and high quality printing is further enabled.

In this example, cooling means and heating means are provided, but only the cooling means for heat radiation may be equipped, and a thermistor is provided for temperature sensing means, but other temperature sensing means such as a diode may be provided. Also, the temperature sensing means may not be provided, depending on the use.

While in each of the previously-described examples, the present invention was described using a printer having an ink jet recording head carried or mounted on the carriage as the head carrying portion, it will be appreciated that the present invention can be suitably applied to an information processing apparatus having a scanner unit which can be mounted on the carriage to be compatible with the ink jet recording head because of having substantially the same outer shape as the ink jet recording head, and which can read image information from the original sheet supported on the platen.

Besides an ink jet recording apparatus of the serial type as shown in each of the previously-described examples, the present invention can be suitably applied to an ink jet recording apparatus for carrying on the head carrying portion a so-called recording head of the full-line type having the nozzles discharge ports corresponding to the entire width of the recording medium in a direction substantially orthogonal to a conveyance direction of the recording medium. In this case, if various types of temperature stabilization means or heat radiation means as shown in the previous examples are provided to be capable of contacting with a full-line recording head, it goes without saying that the same effect as in the case of the ink jet recording apparatus of the serial type can be obtained.

Further, it also goes without saying that the combination of each of the first to fifth examples and each or some of the sixth to tenth examples can provide further effect.

Further, the recording head and various types of temperature stabilization means or heat radiation means are desirably in the form of direct contact, but if the heat transfer is not substantially prevented, both may not be in the form of direct contact.

As described above, according to each of the examples, it is possible to provide an ink jet recording apparatus having a replaceable recording head, wherein temperature stabilization means or heat radiation means having a high heat conductivity which makes contact with the recording head is provided on the carrying portion for carrying the recording head, whereby the temperature elevation of the recording head is suppressed, without increase in the size and cost of the recording head, to cope with the more nozzles, the higher discharge frequency and the color printing.

What is claimed is:

1. A recording apparatus for recording on a recording medium using a recording head, the apparatus, comprising:

a housing;

a carriage that holds and reciprocally moves said recording head in a manner such that said recording head is opposable to the recording medium;

a temperature stabilization portion provided on said carriage so that said temperature stabilization portion is contactable with said recording head held by said carriage, said temperature stabilization portion contacting a heat generating portion of said recording head and dissipating heat generated by said heat generating portion; and a housing side heat dissipating portion at a portion of said housing contacting a portion of said carriage, where said temperature stabilization portion is provided, when said carriage is located at a predetermined position within a moving route of said carriage, said housing side heat dissipating portion dissipating heat from said temperature stabilization portion to the outside of said carriage when said carriage stops at the predetermined position.

2. A recording apparatus according to claim 1, wherein said carriage is reciprocatable along said recording medium in a direction different from a conveyance direction of said recording medium.

3. A recording apparatus according to claim 1, wherein said temperature stabilization portion comprises a metallic member as a heat transfer member, and further comprising biasing means for biasing said temperature stabilization portion to contact a neighborhood of an ink discharge portion of said recording head.

4. A recording apparatus according to claim 3, wherein said metallic member is irregular on a surface thereof, with a high ratio of surface area to volume.

5. A recording apparatus according to claim 3, wherein said metallic member is a positioning member of said recording head.

6. A recording apparatus according to claim 3, wherein said metallic member is movable in a direction for contacting said recording head.

7. A recording apparatus according to claim 3, wherein after said recording head has been set at a defined position of said carriage by a biasing force of said biasing means, said biasing force acts on said recording head.

8. A recording apparatus according to claim 3, wherein said metallic member is electrically connected to said housing.

9. A recording apparatus according to claim 3, wherein said metallic member has a cooling element.

10. A recording apparatus according to claim 3, wherein said metallic member has a cooling element and a heating element.

11. A recording apparatus according to claim 3, wherein said metallic member has a temperature sensor.

12. A recording apparatus according to claim 3, wherein said temperature stabilization portion comprises a built-in component of said carriage.

13. A recording apparatus according to claim 1, wherein the recording head is detachable and said temperature stabilization portion comprises sensing means for sensing whether or not the recording head is mounted on said carriage.

14. A recording apparatus according to claim 1, wherein said recording head comprises ink discharge ports that discharge ink and an ink tank that stores ink integrally formed therein.

15. A recording apparatus according to claim 1, wherein said recording head comprises a replaceable ink tank that stores ink dischargeable through ink discharge ports thereof.

16. A recording apparatus according to claim 1, wherein said recording head comprises at least 70 ink discharge ports.

17. A recording apparatus according to claim 1, wherein said recording head is recordable in at least 80 columns.

18. A recording apparatus according to claim 1, wherein said recording head comprises electrothermal converters that generate heat energy for discharging ink.

19. A recording apparatus according to claim 18, wherein said recording head comprises discharge ports and discharges ink through the discharge ports by heat energy generated by said electrothermal converters.

20. A recording apparatus according to claim 1, wherein said temperature stabilizion portion is located on a front side of a moving direction of said carriage.

21. A recording apparatus according to claim 1, wherein said predetermined position is a home position of said carriage.

22. A recording apparatus according to claim 1, wherein said recording head is an ink jet recording head for recording on the recording medium by discharging ink.

23. An ink jet recording apparatus for recording on a recording medium using an ink jet recording head that records by discharging ink through ink discharge ports, said ink jet recording apparatus comprising:

a housing;

a carriage having a mounting portion on which said ink jet recording head is mountable opposite said recording medium and which is reciprocatable along said recording medium in a direction different from a conveyance direction of said recording medium, said carriage being movable to displace said ink jet recording head between a mounting position, where said ink jet recording head is mounted and a disengaging position, spaced from said mounting position, where said ink jet recording head is disengaged from said carriage;

heat radiation means for radiating heat from said ink jet recording head, said heat radiation means being provided on said carriage and contactable with said ink jet recording head mounted on said mounting portion, said heat radiation means being displaceable between a contact position, where said heat radiation means is in contact with said ink jet recording head, and a non-contact position, where said heat radiation means is not in contact with said ink jet recording head;

displacement operating means for effecting displacement of said ink jet recording head to said mounting position and displacement of said heat radiation means to said contact position, said displacement operating means effecting a series of displacement operations to displace said ink jet recording head to said mounting position and then to bring said heat radiation means into contact with said ink jet recording head; and a housing side heat dissipating portion at a portion of said housing contacting a portion of said carriage, where said heat radiation means is provided when said carriage is located at a predetermined position within a moving route of said carriage, said housing side heat dissipating portion dissipating heat from said heat radiation means to the outside of said carriage when said carriage stops at the predetermined position.

24. An ink jet recording apparatus according to claim 23, wherein said heat radiation means is resiliently biased away from said non-contact position in a direction toward said contact position.

25. An ink jet recording apparatus according to claim 23, wherein said heat radiation means contacts a neighborhood of said ink discharge ports of said ink jet recording head at said contact position.

26. An ink jet recording apparatus according to claim 23, wherein said heat radiation means includes a metallic material having a high heat conductivity.

27. An ink jet recording apparatus according to claim 23, wherein said ink jet recording head includes electrothermal converters and discharges ink through said ink discharge ports using heat energy generated by said electrothermal converters.

28. An ink jet recording apparatus according to claim 23, wherein said temperature stabilizion portion is provided on a front side of a moving direction of said carriage.

29. An ink jet recording apparatus according to claim 23, wherein said predetermined position is a home position of said carriage.

* * * * *

UNITED STATES PATENT AND TRADEMARK OFFICE

CERTIFICATE OF CORRECTION

PATENT NO. : 5,880,754

DATED : March 9, 1998

INVENTOR(S) : NIIKURA ET AL.

It is certified that error appears in the above-identified patent and that said Letters Patent is hereby corrected as shown below:

COLUMN 1:

Line 37, "Jet" should read --jet--.

COLUMN 2:

Line 52, "5A and 5B" should read --5A-5D--.

COLUMN 9:

Line 31, "not" should be deleted.

COLUMN 12:

Line 18, "may" should read --may be--.

COLUMN 15:

Line 16, "apparatus," should read --apparatus--.

Signed and Sealed this

Fifth Day of October, 1999

*Attest:*

*Attesting Officer*

Q. TODD DICKINSON

*Acting Commissioner of Patents and Trademarks*